United States Patent [19]

Schmidt

[11] Patent Number: 4,932,087

[45] Date of Patent: Jun. 12, 1990

[54] BATHTUB INSERT FOR HANDICAPPED PERSONS

[76] Inventor: Peter Schmidt, Wittumweg 38, 7989 Eisenharz, Fed. Rep. of Germany

[21] Appl. No.: 369,339

[22] Filed: Jun. 21, 1989

[30] Foreign Application Priority Data

Jun. 23, 1988 [DE] Fed. Rep. of Germany ..... 3821192

[51] Int. Cl.[5] ..... A47K 3/12

[52] U.S. Cl. ..... 4/560; 4/566; 4/579; 4/563; 4/564

[58] Field of Search ..... 4/546, 548, 555, 559, 4/560, 561, 563, 564, 566, 460, 254, 562, 565; 297/486, 284, 378; D12/128

[56] References Cited

U.S. PATENT DOCUMENTS

| | | | |
|---|---|---|---|
| 2,635,679 | 4/1953 | McDonald | 297/378 |
| 3,123,400 | 3/1964 | Paulson | 4/560 |
| 3,382,527 | 5/1968 | Strien et al. | 297/378 |
| 4,177,528 | 12/1979 | James | 4/254 |
| 4,495,666 | 1/1985 | Herman, Jr. | 4/566 |
| 4,557,002 | 12/1985 | Schmidt | 4/566 |
| 4,574,408 | 3/1986 | Dentler et al. | 4/560 |
| 4,660,234 | 4/1987 | Schmidt | 4/566 |
| 4,768,239 | 9/1988 | Pauley | 4/564 |

*Primary Examiner*—Henry J. Recla
*Assistant Examiner*—Keith Kupferschmid
*Attorney, Agent, or Firm*—Notaro & Michalos

[57] ABSTRACT

A bathtub insert (10) comprises a seat plate (16) which can be raised and lowered by a lifting device (12). A back plate (18) is arranged on the seat plate (16) and a pair of side plates (22) are mounted at the side edges of the back plate (18) respectively by means of hinge arrangements (24) comprising snap-in locking devices. The hinge arrangements can be unlocked by lifting the side plates by a small amount. In the raised position each side plate (22) can be freely swung forwards or backwards and upon release is automatically locked again. Also the back plate (18) is mounted at the seat plate (16) by such a hinge arrangement (24) in order to lock the back plate in one of a plurality of positions of inclination.

12 Claims, 4 Drawing Sheets

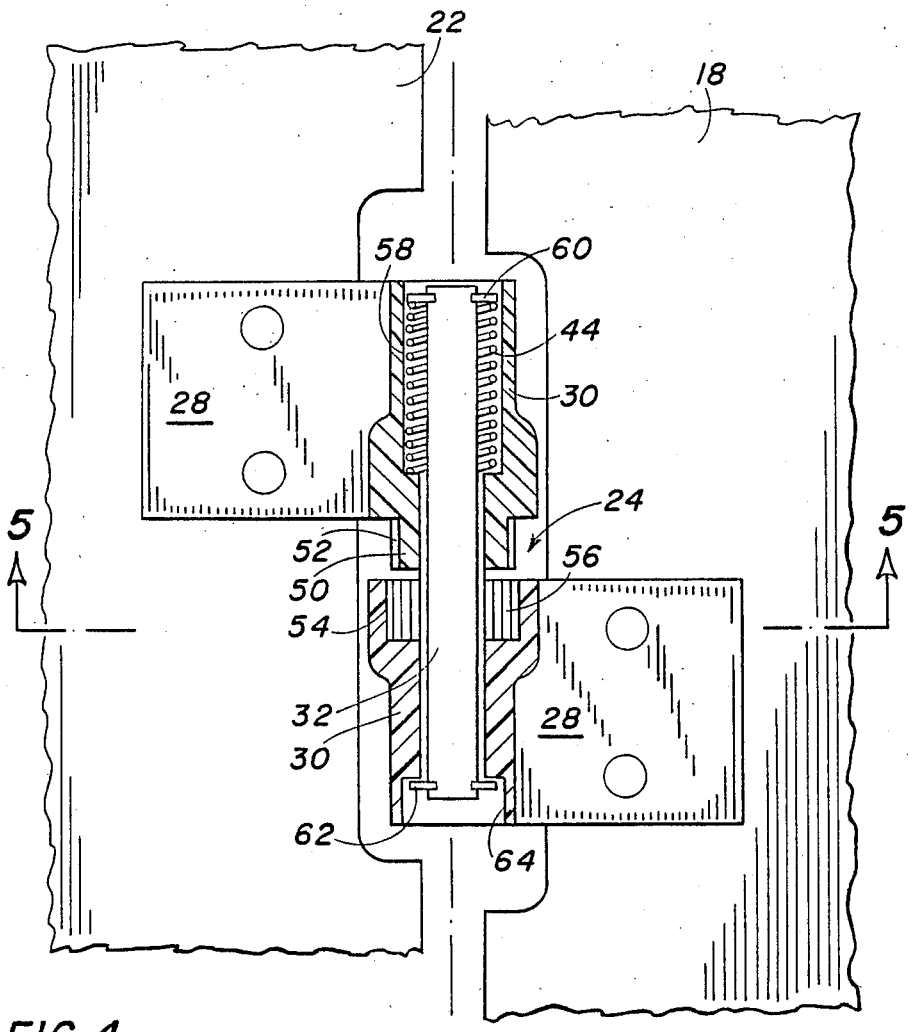
FIG. 4
FIG. 5
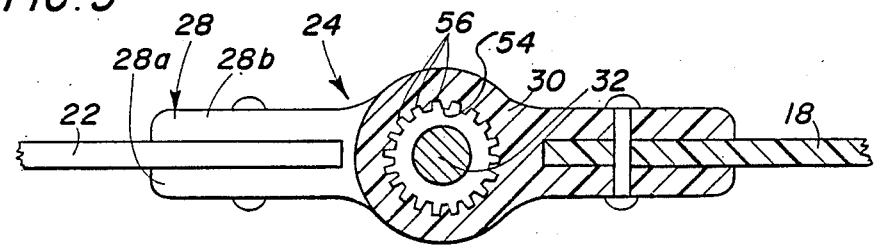

BATHTUB INSERT FOR HANDICAPPED PERSONS

BACKGROUND OF THE INVENTION

The invention relates to a bathtub insert for handicapped persons comprising a bottom frame, a scissor-type guiding device mounted on said bottom frame, a seat-plate supported by said guiding device, a lifting device consisting of a water-fillable hose closed at its ends, one end of the hose fastened at the bottom frame and the other end fastened at the seat plate, a control device for filling and draining the hose, and a back plate supported by the seat plate.

A bathtub insert of this kind is known from my U.S. Pat. No. 4,660,234. The back plate comprises a pair of downwardly and forwardly extending arms which project through openings provided in the seat plate and undergrip the seat plate. An adjustment of the inclination is not possible. Also any side holders are missing. Therefore it does exist a danger for handicapped persons during lowering and raising of the seat plate to become tilted sidewards, and to become injured.

SUMMARY OF THE INVENTION

It is therefore one aim of the invention to improve a bathtub insert of the kind mentioned above which provides lateral supporting means at both sides of the back plate avoiding tilting of the handicapped person.

One further object of the invention it to provide a combination of a back plate and lateral supporting means which allow to simply adjust the combination for small and big persons.

One further object of the invention is to provide a bathtub insert which allows to swing the back plate about a transverse axis and to securely hold the back plate in a selected one of a plurality of angles of inclination.

Last but not least it is an object of the invention to provide a back plate arrangement for a bathtub insert comprising a pair of side plates pivotably arranged at both upright side edges of the back plate respectively by means of hinge arrangements, which allow a quick and easy angle-adjustment with respect to the back plate.

Also one object of the invention is to provide a bathtub insert having a back plate at which a pair of side plates are pivotably connected allowing to simply lift each side plate by a small amount into a release position in which it can be freely swung into another angle position and upon release the side plate automatically becomes locked in another selected locking position.

Thanks to this invention only one type of a back plate arrangement is suitable for handicapped children and for adults, because for small persons the side plates can be arranged substantially rectangularly to the back plate respectively and for large persons the said plates can be swung outwards respectively from a substantial parallel relationship into diverging positions in which they include an angle up to 180 degrees. The side plates can even be swung beyond that 180°-position backwards in direction to the back side of the back plate so that the person can enter and leave the seat plate sidewards.

The back plate arrangement comprising the pair of side plates as a whole can simply be removed from the seat plate according to one embodiment and after having folded the side plates can be stored in from of a flat package. According to an alternative embodiment the back plate can be swung forwards and downwards onto the seat plate with the side plates folded inwards to lie closely adjacent the back plate at the front side or rearward side thereof. In the latter embodiment the back plate arrangement forms an integral component of the seat plate.

It should be understood that the term "seat plate" is not limited to plates of a small length but includes also reclining platforms extending substantially over the whole length of the bathtub.

BRIEF DESCRIPTION OF THE DRAWINGS

FIG. 4 shows a sectional view of a second embodiment of a hinge arrangement;

FIG. 5 shows a cross-section taken along line 5—5 of FIG. 4; and

DETAILED DESCRIPTION

Figure 1:
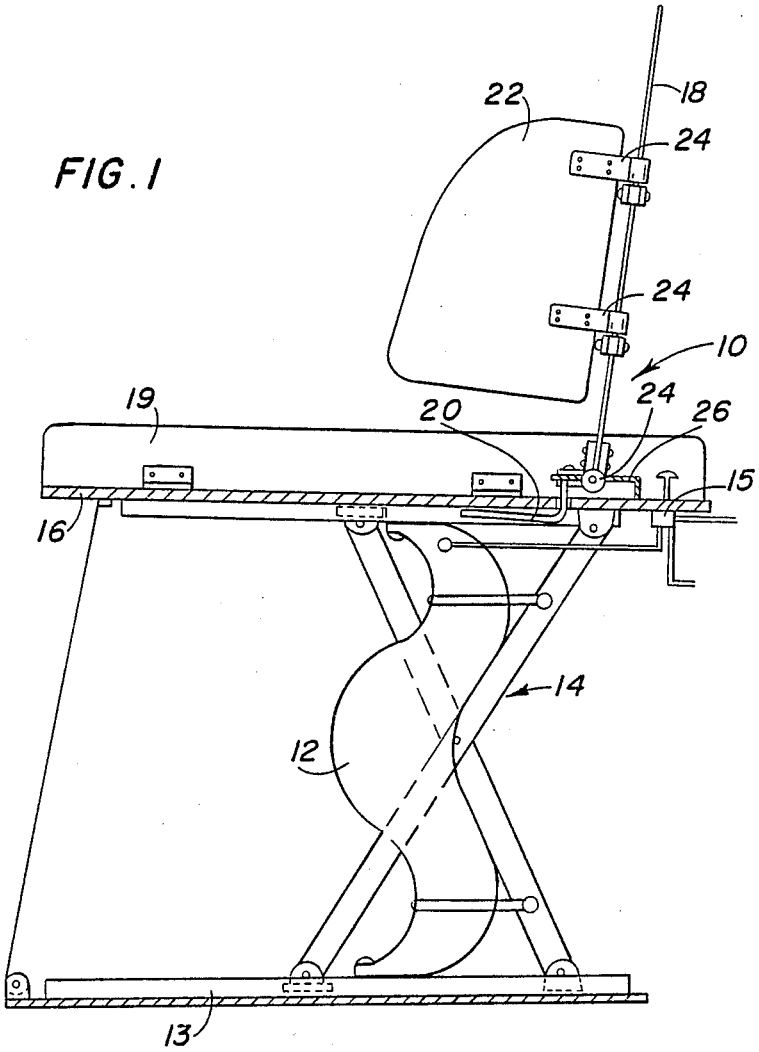
FIG. 1 shows a diagrammatic sectional side view of a bathtub insert.

A bathtub insert 10 comprises a seat plate 16, a scissor-type guiding device 14 mounted on a bottom frame 13 and supporting the seat plate 16. A lifting device 12 consists of a water-fillable hose closed at its ends. One end of the hose is fastened at the bottom plate 13. The other one is fastened at the seat plate 16. A control device 15 containing a valve serves to connect the lifting device 12 either with a water supply hose or with a draining hose or to shut off the lifting device from both hoses. A back plate 18 is removably arranged on the seat plate 16. At both sides of seat plate 16 a side flap 19 is pivoted respectively and forced by a spring hinge into contact with a side wall of the bathtub.

A hinge arrangement is formed by an upper and a lower hinge 24 which are fastened at the side edges of the back plate 18 respectively. A pair of side plates 22 are pivotably mounted at the back plate 18 by that hinge arrangements. The pivot axes of the hinge arrangements extend substantially parallel with the back plate 18 so that the side plates 22 can be swung into forward positions (FIG. 1), in which they are substantially parallel with one another and form substantially right angles with the back plate 18 respectively. Each hinge 24 comprises a snap-in locking device providing a multiplicity of snap-in positions to hold the respective side plate 22 in one of a multiplicity of pivoting angles with respect to the back plate 18. In order to overcome the snap-in locking effect, the side plate 22 need only be lifted by a small amount into a releasing position and then can be freely swung outwards and even backwards to allow a lateral access of the seat plate 16.

Figure 2:
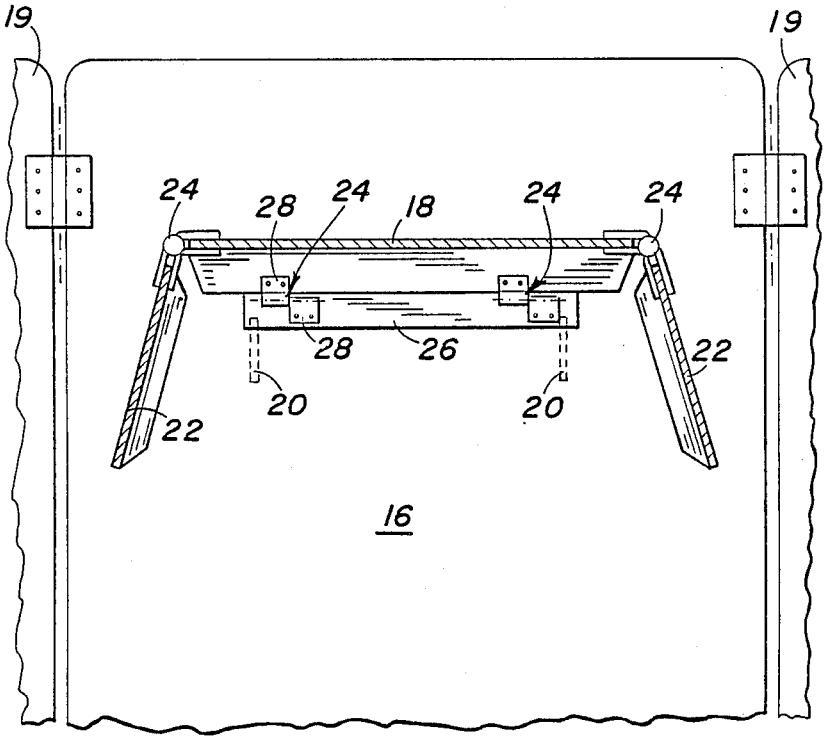
FIG. 2 shows a horizontal cross-section of a back plate arrangement mounted on a seat plate of the bathtub insert.

FIG. 2 shows the side plates 22 in operating positions in which they extend forwards and somewhat outwards respectively.

Figure 3:
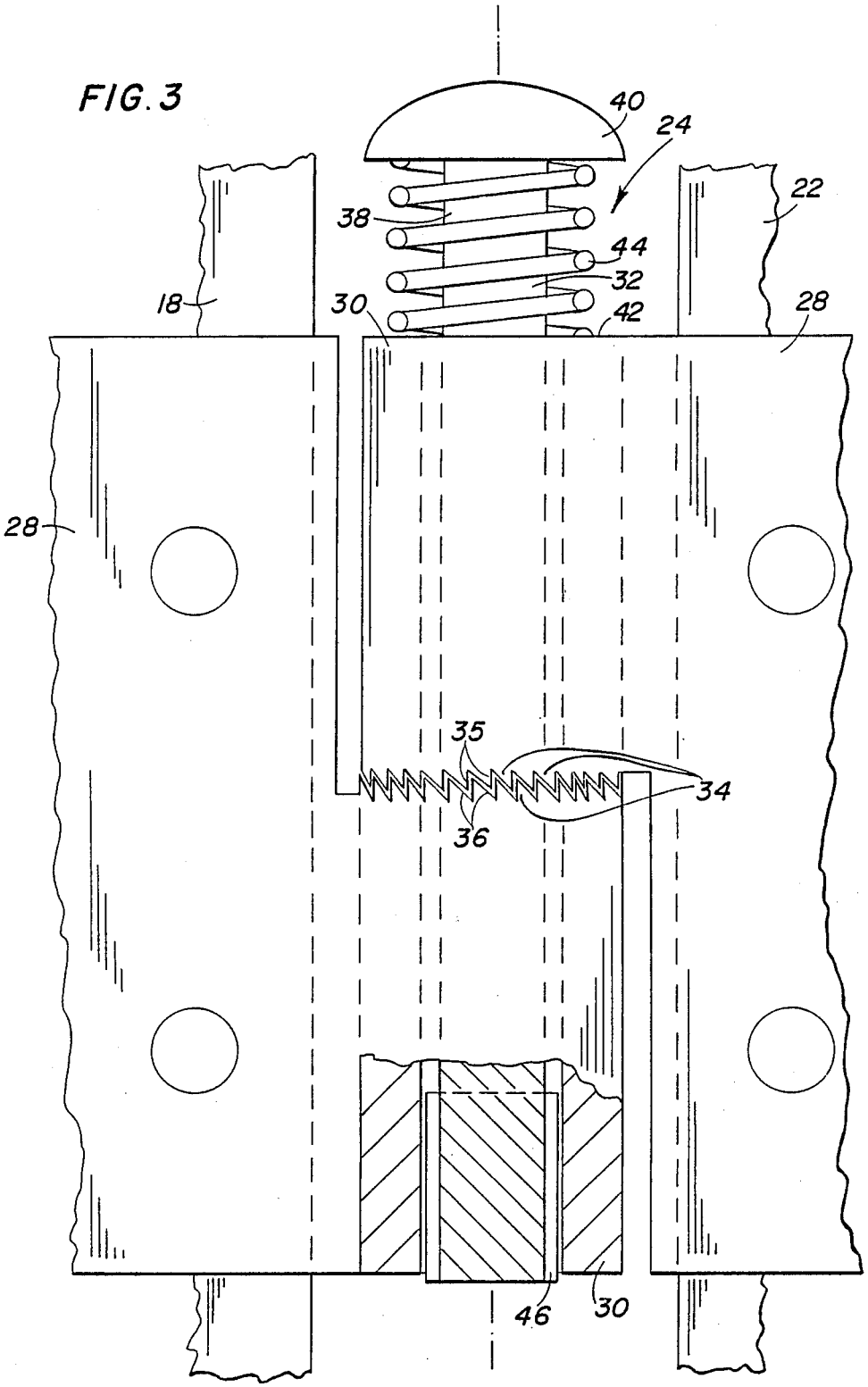
FIG. 3 shows one embodiment of a hinge arrangement in greater detail by which side plates are mounted at a back plate and the latter at the seat plate.

FIG. 3 shows a hinge 24 in greater detail. A pair of identical hinge flaps 28 have bushings 30 in the form of rolled-round plate portions. The bushings 30 extend only in one half of the flap length, so that a recess is provided in the other half thereof. By turning one flap 28 upside-down, the bushing 30 of this flap 28 extends into the recess of the other flap so that both bushings 30 are axially aligned. A hinge stem 32 projects through both bushings 30 and is provided with axial ribs 46 at one end thereof which are pressed into the bushing 30 to fasten the stem in the bushing. The stem 32 projects beyond the other bushing with a stem portion 38 and carries a head 40. A helical pressure spring 44 is inserted between the head 40 and the adjacent end face 42 of that bushing 30 which is mounted for pivoting motion about the stem and for axial displacement thereon. The spring 44 urges the movable bushing 30 in contact with the fixed bushing. The respective annular contact surfaces of the bushings 30 are toothed in form of dentate-serrate profiles comprising a plurality of teeth 34. Each tooth 34 has a steep locking surface 35 which extends substantially in axial direction and an inclined sliding surface 36. The toothings of the bushings 30 extend along the whole peripheries thereof and together with spring 44 form a locking arrangement which, however only operates in one pivoting direction. FIG. 3 shows a hinge 24 at the right side of FIG. 2. Therefore, the side plate 22 is locked against an outward swing. If the side plate 22 is raised by hand axially with respect to the swing axis against the pressure of spring 44 it can be freely swung outwards into another angle position and upon releasing, the side plate 22 snaps in again and is locked. In the opposite direction no locking effect does exist, and the side plate can be swung inwards whereby the teeth 34 of one bushing 30 slide over those of the other bushing.

FIG. 4 shows an alternative embodiment of a hinge 24, which differs from that shown in FIG. 3 in that one bushing 30 has an axially projecting hollow end portion 50 provided with a plurality of peripherally spaced axial ridges 52 and the other bushing 30 has a bore portion 54 provided with peripherally spaced axial grooves 56. The end portion 50 is urged into the bore portion 54 by means of the spring 44 whereby the ridges 52 fit into the grooves 56 and provide a locking effect. However, differing from the first embodiment this locking effect takes place in both pivoting directions. Therefore, the side plate 22 must be always raised until the end portion 50 gets out of the bore portion 54 in order to overcome the locking effect as shown in FIG. 4. Thereafter the side plate 22 can be freely swung in both directions and upon release the end portion 50 snaps into the bore portion 54 again to lock the side plate.

According to a further difference of the embodiment shown in FIG. 4 with respect to that of FIG. 3 the stem 32 does not project outwards beyond the sleeves 30, because the spring 44 is arranged within a bore 58 of the one bushing 30. Instead of a head 40, as shown in FIG. 3, a circlip ring 60 is inserted into a groove of the stem at one end thereof, and by means of a similar ring 62 at the other end of the stem 32 , the stem is supported axially at an annular shoulder of a recess 64 formed in the other bushing 30.

As shown in FIG. 5, each hinge flap 28 consists of a pair of parallel fastening plates 28*a*, 28*b* integrally connected with the bushing 30 and providing a gap therebetween into which the side plate 22 or the back plate 18 is inserted and fastened by rivets.

Figure 6:
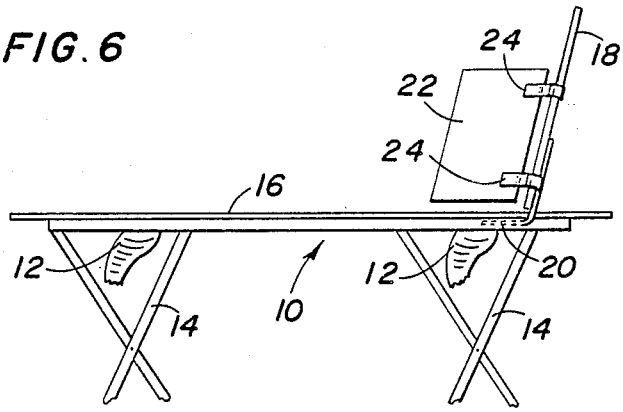
FIG. 6 shows a diagrammatic side view of a bathtub insert comprising a long reclining platform on which the back plate arrangement is mounted.

According to FIG. 6 the back plate 18 is provided with a pair of supporting arms 20 which extend downwards through openings provided in a reclining platform forming the seat plate 16 and then project forwards below the seat plate. Differing from that, the supporting arms 20 according to FIG. 1 are fastened at a supporting plate 26 which is removably supported on the deck side of the seat plate 16 below the back plate 18. The back plate 18 is pivotably mounted at the supporting plate 26 about a horizontal transverse axis by means of a hinge arrangement 24 composed of two hinges each one comprising a pair of hinged flaps 28 as described above with respect to FIG. 3 or FIG. 4. Therefore, the inclination of the back plate 18 can be adjusted. Firstly the back plate 18 is urged transversely by a small amount to overcome the locking effect. Thereafter the back plate is swung into the desired position downwards and then upon release is automatically locked by means of the snap-in locking devices provided by the interengaging toothings 34 or 52, 56 of the bushings 30. It should be understood, that the supporting plate 26 can be omitted if a removal of the back plate 18 is dispensed with. Then the back plate hinge arrangement is directly fastened at the seat plate.

I claim:

1. A bathtub insert for handicapped persons comprising a bottom frame, a scissor-type guiding device mounted on said bottom frame, a seat-plate supported by said guiding device, a lifting device consisting of a water-fillable hose closed at its ends, one end of the hose fastened at the bottom frame and the other end fastened at the seat plate, a control device for filling and draining the hose, and a back plate supported by the seat plate, characterized in that a pair of side plates are mounted for swinging movements at the back plate by means of first hinge arrangements respectively about axes substantially parallel with the back plate, and that each first hinge arrangement comprises a snap-in locking device providing a plurality of snap-in positions to hold each one of the pair of side plates in one of a plurality of pivoting angles with respect to the back plate.

2. A bathtub insert as claimed in claim 1 and further for handicapped persons comprising a bottom frame, a scissor-type guiding device mounted on said bottom frame, a seat plate supported by said guiding device, a lifting device consisting of a water-fillable hose closed at its end, one end of the hose fastened at the bottom frame and the other end fastened at the seat plate, a control device for filling and draining the hose, and a back plate supported by the seat plate, characterized in that the back plate supported by a second hinge arrangement comprises a snap-in movement about a transverse axis parallel with the seat plate and that the second hinge arrangement for a swinging locking device providing a plurality of snap-in positions to hold the back plate in one of a plurality of angles of inclination respectively.

3. A bathtub insert as claimed in claim 2, wherein the second hinge arrangement comprises at least one pair of second hinged flaps one flap fastened at a lower edge of the back plate and the other one fastened at a rigid supporting plate, the latter extends transversally along the lower edge of the back plate and rests on the seat plate, and wherein a pair of arms are fastened at the lower side of the supporting plate, project through openings provided in the seat plate and extend forwards in contact with the bottom surface of the seat plate.

4. A bathtub insert as claimed in claim 2, wherein the second hinge arrangement comprises at least one pair second hinged flaps displaceably arranged with respect to one another in the direction of the hinge axis from a locking position into a releasing position, in which latter the second hinged flaps are freely pivotable with respect to one another about the second hinge axis.

5. A bathtub insert as claimed in claim 1, wherein the first hinge arrangement comprises at least one pair of first hinged flaps displaceably arranged with respect to one another in the direction of the first hinge axis from a locking position into a releasing position, in which latter the first hinged flaps are freely pivotable with respect to one another about the first hinge axis.

6. A bathtub insert as claimed in claim 1, wherein said pair of first hinged flaps are pre-loaded by a spring in the direction to the locking position respectively.

7. A bathtub insert as claimed in claim 6, wherein each one of the pair of first hinged flaps comprises at least one bushing, a stem extends through the bushings of said first hinged flaps, one of the bushings is arranged for a relative axial displacement with respect to the stem which is provided with an abutment at one end thereof, a helical compression spring surrounding the stem is inserted between the abutment and that bushing which is relatively displaceable with respect to the stem and that at least one of said pair of bushings is rotatably arranged with respect to the stem.

8. A bathtub insert as claimed in claim 7, wherein the bushings of said pair of first flaps are provided with toothed end faces facing one another and in the locking position of the first hinge arrangement being in engagement with one another in a form-fit manner.

9. A bathtub insert as claimed in claim 8, wherein the toothed end faces have dentate-serrate profiles respectively, comprising a plurality of teeth, each one provided with a steep locking surface and an inclined sliding surface, so that the teeth of both end faces form a locking arrangement in one pivoting direction of the first hinge arrangement and in the opposite direction the teeth of one first hinged plate slide over those of the other one.

10. A bathtub insert as claimed in claim 7, wherein one bushing is provided with a hollow end portion which extends axially into a bore portion of the other bushing and wherein one of said portions is provided with a plurality of peripherally spaced axial grooves and the other one is provided with at least one axial ridge fitting into each one of the grooves.

11. A bathtub insert as claimed in claim 1, wherein the first hinge arrangement comprises at least one pair of first hinged flaps, at least one flap comprises a bushing and a pair of fastening plates integrally connected therewith, the pair of fastening plates are parallel with one another and a gap is formed therebetween and one of the items comprising the seat plate, the back plate, a side plate, and a supporting plate is filled into the gap and fastened at the pair of fastening plates.

12. A bathtub insert as claimed in claim 1, wherein the first hinge arrangement comprises at least one pair of first hinged flaps, at least one flap comprises a bushing and a pair of fastening plates integrally connected therewith, the pair of fastening plates are parallel with one another and a gap is formed therebetween and one of the items comprising the seat plate, the back plate, a side plate, and a supporting plate is fitted into the gap and fastened at the pair of fastening plates.

* * * * *